US006318894B1

(12) United States Patent
Derenthal

(10) Patent No.: US 6,318,894 B1
(45) Date of Patent: Nov. 20, 2001

(54) RESEALABLE FLEXIBLE PACKAGES HAVING HOOK DESIGN TEAR LINE

(75) Inventor: Jerome W. Derenthal, Lebanon, NJ (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/684,549

(22) Filed: Oct. 6, 2000

Related U.S. Application Data

(60) Provisional application No. 60/157,854, filed on Oct. 6, 1999.

(51) Int. Cl.[7] ..... B65D 33/00

(52) U.S. Cl. ..... 383/204; 383/61; 383/63; 383/35; 383/209; 383/211

(58) Field of Search ..... 383/61, 66, 203, 383/204, 207, 208, 209, 211, 63, 35; 229/237, 313, 314, 315, 316, 87.05

(56) References Cited

U.S. PATENT DOCUMENTS

| | | | | |
|---|---|---|---|---|
| D. 323,979 | | 2/1992 | Forman et al. . | |
| 1,336,646 | * | 4/1920 | Mendenhall | 229/313 X |
| 2,260,064 | | 10/1941 | Stokes . | |
| 2,266,958 | | 12/1941 | Corbin . | |
| 2,680,558 | * | 6/1954 | Mai | 229/237 X |
| 2,946,434 | | 7/1960 | Brina . | |
| 2,949,370 | | 8/1960 | Hughes . | |
| 2,967,010 | * | 1/1961 | Cuffey, Jr. et al. | 229/237 X |
| 3,330,469 | | 7/1967 | Koncak . | |
| 3,473,589 | | 10/1969 | Gotz . | |
| 3,519,197 | | 7/1970 | Campbell . | |
| 3,585,784 | | 6/1971 | Trieber . | |
| 3,665,673 | | 5/1972 | Billett et al. . | |
| 3,780,781 | | 12/1973 | Uramoto . | |
| 3,827,472 | | 8/1974 | Uramoto . | |
| 3,850,780 | | 11/1974 | Crawford et al. . | |
| 3,943,686 | | 3/1976 | Crawford et al. . | |
| 4,106,265 | | 8/1978 | Aterianus . | |
| 4,285,105 | | 8/1981 | Kirkpatrick . | |
| 4,363,345 | | 12/1982 | Scheibner . | |
| 4,512,138 | | 4/1985 | Greenawalt . | |
| 4,572,377 | | 2/1986 | Beckett . | |
| 4,620,467 | | 11/1986 | Margraf et al. . | |
| 4,691,372 | | 9/1987 | Van Erden . | |
| 4,709,533 | | 12/1987 | Ausnit . | |

(List continued on next page.)

FOREIGN PATENT DOCUMENTS

| | | | | |
|---|---|---|---|---|
| 1 112 446 | | 8/1961 | (DE) . | |
| 2 117 349 | | 10/1983 | (GB) . | |
| 0536595 | * | 6/1958 | (IT) | 229/313 |
| 51-103173 | | 9/1976 | (JP) . | |

*Primary Examiner*—Jes F. Pascua
(74) *Attorney, Agent, or Firm*—Hollander Law Firm, P.L.C.

(57) ABSTRACT

A reclosable bag with a line of weakened tear resistance having a fish hook or hook shaped perforations assures a straight-line tear across the bag. The hook-like perforations avoid cross-tearing of the package towards the top edge or towards the bottom edge of the package and provide an easy access to the packaged goods. The non-symmetrical hook perforations have a major central portion or vertical center section substantially parallel to each other and to the sides of the bag, a rounded shoulder and a rounded foot. The tear line extends from one side edge of the bag to and stops short before reaching the other side edge of the bag. The non-symmetrical hook perforations are obtained by cutting a bag with a cutting knife with hook-designed cutting edges that mirror the perforations. The cutting knife may be incorporated onto rotary film sealing and crimping heads for providing top and bottom permanent seals on successively perforated bags. The bag may also comprise a reclosable seal located below the line of weakened tear resistance. The bag may also contain dimples embossed into either the front or back panels across the line of weakened tear resistance. The dimples assist in separating the bag's front and back panels during the opening process.

14 Claims, 9 Drawing Sheets

U.S. PATENT DOCUMENTS

| | | |
|---|---|---|
| 4,712,357 | 12/1987 | Crawford et al. . |
| 4,786,190 | 11/1988 | Van Erden et al. . |
| 4,829,641 | 5/1989 | Williams . |
| 4,907,321 | 3/1990 | Williams . |
| 4,909,016 | 3/1990 | Rentmeester et al. . |
| 4,909,017 | 3/1990 | McMahon et al. . |
| 4,936,817 | 6/1990 | Runge . |
| 4,949,846 | 8/1990 | Lakey . |
| 4,986,673 | 1/1991 | Bell . |
| 5,056,295 | 10/1991 | Williams . |
| 5,078,509 | 1/1992 | Center et al. . |
| 5,144,787 | 9/1992 | Whitby et al. . |
| 5,167,455 | 12/1992 | Forman . |
| 5,248,201 | 9/1993 | Kettner et al. . |
| 5,356,222 | 10/1994 | Kettner et al. . |
| 5,437,881 | 8/1995 | Jeannin . |
| 5,518,119 | 5/1996 | Takahashi . |
| 5,527,112 | 6/1996 | Dais et al. . |
| 5,558,438 | 9/1996 | Warr . |
| 5,582,887 | 12/1996 | Etheredge . |
| 5,582,889 | 12/1996 | Pedrini . |
| 5,678,390 | 10/1997 | Pruett et al. . |
| 5,725,311 | 3/1998 | Ponsi et al. . |
| 5,741,075 | 4/1998 | Collins et al. . |
| 5,775,065 | 7/1998 | Tolson . |

* cited by examiner

RESEALABLE FLEXIBLE PACKAGES HAVING HOOK DESIGN TEAR LINE

This application claims benefit of Provision No. 60/157,854 filed Oct. 6, 1999.

FIELD OF THE INVENTION

The present invention relates to packages such as flexible resealable bags or pouches having a tear line with perforations designed in a form of hooks that allows for easy, quick straight line removal of a permanent seal, avoids undesirable cross-tearing of the package, provides tamper evidence, and provides a means for reclosing or resealing the package for containment and protection of unused articles within the package. The invention further relates to a knife or a blade used for manufacturing flexible bags having a tear line comprising hook perforations.

BACKGROUND OF THE INVENTION

Flexible packages such as bags or pouches are relatively inexpensive and convenient for containing a variety of food items such as snacks, cold cuts, cookies, pasta, or other food items or non-food items, which are produced on a mass production continuous basis. Flexible packages serve to store the enclosed products, protect the enclosed goods from spoiling or contamination, keep the enclosed goods together and facilitate handling of the goods as a single unit, provide tamper resistance and tamper evidence. To achieve these purposes, flexible packages containing food items are sealed with various types of seals and delivered sealed to the end user of such items. To gain access to the enclosed goods, the flexible package has to be opened by breaking or tearing off the seal. In many cases, the packages contain a plurality of items, such as cookies, various snacks, pasta, or cold cuts that may not be consumed at once. For convenience, it is usually desirable to maintain the remaining items in the original package and remove the remaining items from the package later and, often, in several portions. It is, therefore, important to remove the permanent seal with minimal damage to the rest of the package while tearing off or breaking the permanent seal. Also, in cases when not all of the packaged product is consumed at once, it may be desirable for the package to be reclosable or resealable. This feature allows the consumer to re-open the package after it has been initially opened for easy and repeat access to the items stored in the package on the one hand. On the other hand, it allows the consumer to close or reseal the package for freshness, protection, and storage of unused items in the original package.

Sealed flexible packages that can be easily opened, and, if desired, resealed or reclosed, and methods and machines for making such flexible packages have been known and disclosed in the art.

U.S. Pat. No. 2,949,370 to Hughes discloses a bag with an outer permanent seal and inner reclosable seal. The reclosable seal can be in the form of an adhesive strip, which covers a slot and is engaged with itself to reseal the bag. No intermediate perforation for easy removal of the permanent seal is disclosed.

U.S. Pat. No. 3,330,469 to Koncak discloses a resealable bag comprising a permanent seal, a line along which the permanent seal can be cut off, and an inner reclosable strip. The reclosable strip is a metallic strip that is much stiffer than the bag and allows the bag to stay closed when the bag is folded along a line extending along the metallic strip.

U.S. Pat. No. 3,473,589 to Gotz discloses an interlocking reclosable seal and a permanent seal that is cut off along predetermined lines of weakened tear resistance. The design of the tear line is not provided.

U.S. Pat. No. 3,519,197 to Campbell discloses a permanently sealed bag that can be easily opened along a "line of weakness", i.e. a perforated line that appears on one side wall of the bag. There is no disclosure of any reclosable seals, or tear-off of the permanent seal.

U.S. Pat. No. 3,780,781 to Uramoto discloses a resealable bag with reclosable profiles, reinforced upper tear-off strips and tear lines of weakened resistance between the reclosable profiles and the reinforced tear-off strip.

U.S. Pat. No. 3,827,472 to Uramoto discloses a resealable bag with reclosable profiles and a tear strip which tears between pairs of guide ribs formed integrally with the inner layers of the bag above the reclosable profiles. The tear line, it is disclosed, does not deviate downwardly or turn upwardly. The guide ribs may be replaced by a perforated line of weakened resistance such as by spaced notches or a V-groove.

U.S. Pat. No. 3,850,780 to Crawford et al. discloses a wrapping machine that produces and heat seals bags made from flexible thermoplastic web material.

U.S. Pat. No. 3,943,686 to Crawford et al. discloses a wrapping machine wherein regularly spaced articles are entubed in a flexible wrapping material, and the tube is sealed and cut between the wrapped articles using rotary crimping heads.

U.S. Pat. No. 4,106,265 to Aterianus discloses a wrapping machine which forms a tube of wrapping material around spaced articles, and seals the articles inside the wrapping film. A rotary crimping, sealing and cut-off device is used to seal the tube and separate the wrapped articles from one another.

U.S. Pat. No. 4,285,105 to Kirkpatrick discloses a bag having reclosable interlocking profiles that change color upon occlusion or locking. The patent does not disclose perforated or any other tear-off lines, or a permanent seal.

U.S. Pat. No. 4,572,377 to Beckett discloses a reclosable, tamper evident package made from flexible polymeric material that has a tear strip on only one face of the package. An adhesive reclosable seal is parallel to the permanent closure and a tear strip is formed in-between the permanent closure and resealable seal. The tear strip can be made from a series of Z-shaped cuts or any other known form that allows the tear strip to be easily removed from one face of the package. When the tear strip is removed from one face of the bag, the permanent closure is still attached to the other face of the bag.

U.S. Pat. No. 4,712,357 to Crawford et al. discloses a computer controlled horizontal wrapping machine which wraps a film around spaced articles, and seals and severs the film between the articles using rotary crimping, sealing heads.

U.S. Pat. No. 4,786,190 to Van Erden et al. discloses different bag designs with permanent and reclosable seals. In one of the designs, the reclosable seal is attached to a flap extending across the width of the bag. The non-reclosable closure has a perforated line concealed by the flap. In another design, the reclosable seal is located above the permanent or non-reclosable seal. There is no disclosure of a tear off line of specific design for any of the embodiments.

U.S. Pat. No. 4,986,673 to Bell discloses a resealable bag comprising a permanent heat seal, a reclosable seal (profile engagement members) and a gap portion extending between the wide heat seal and the reclosable seal. The tear line extends across the gap portion upon tearing off of the heat seal. The patent also discloses tear notches to facilitate tearing. The reference teaches away from score lines. Undesirable cross tears are avoided by use of a reinforced tab portion or permanent seal.

U.S. Pat. No. 5,678,390 to Pruett et al. discloses a horizontal film packaging machine comprising rotary crimping and sealing assembly for sealing heads. The machine has improved temperature control of the sealing surfaces. No perforation knife is disclosed.

U.S. Pat. No. 5,725,311 to Ponsi et al. discloses a resealable bag or plastic package having a reclosable adhesive label which conceals an opening in the bag. The label is used to open and to re-close the opening.

U.S. Pat. No. 5,741,075 to Collins et al. discloses a resealable flexible bag having a label with two adhesive areas separated by a non-adhesive area which extends over an opening.

The present invention provides a flexible, easy to open package that is sealed with permanent seals to protect articles packaged within the package prior to utilization of the packaged articles. The package according to the present invention allows for quick and easy removal of one of the permanent seals, such as one across the top of the package. A perforated line, or a line of weakened tear resistance, is formed of a plurality of hook-like cuts extending across the bag below the permanent seal. The hook designs of the tear line provide not only a quick and easy removal of the permanent seal but also minimizes cross-tearing of the package towards the top edge or towards the bottom edge. The hook designs also provide a scalloped edge when the top seal is torn along the perforated line, thereby providing tamper evidence superior to conventional perforated lines formed of a plurality of straight in-line cuts. The hook designs of the present invention may be employed on all types of flexible packages such as flexible bags and pouches for food and non-food items.

In embodiments of the invention, the package is a reclosable package that can be reopened and reclosed several times. The reclosable feature may be in the form of interlocking profiles or a pressure sensitive adhesive seal that may also be tamper evident.

The invention further provides for a perforation or cutting knife comprising a perforation edge of a specific design that allows for manufacturing of the flexible bags having a line of weakened tear resistance which is formed of a plurality of hook-like cuts.

SUMMARY OF THE INVENTION

The resealable bag of the present invention allows for easy access to the items enclosed within the bag. A permanent seal extends across the top of the bag. A score line having a fish hook perforation design, located below the permanent seal, provides a line of weakened tear resistance, or tear line, extending parallel to the top seal. The fish hook design of the tear line avoids cross-tearing of the package towards the top edge or towards the bottom edge. The tear line extends from one side edge of the bag to and stops short before reaching the other side edge of the bag. The bag may also comprise an optional end notch located at the beginning of the tear line to insure that the tear occurs at the desired location for embodiments where the tear line is designed to start a short distance from the edge of the bag. The bag may further comprise an inner reclosable seal located below the tear line.

The fish hook perforations assure a straight tear line from one side edge to the other without tearing in the longitudinal direction (cross tearing towards the top edge or bottom edge) of the bag and thereby preventing accidental tearing of the permanent seals, i.e. seals that are not resealable once opened. The fish hook perforations are located on both opposing walls (front and back) of the bag so that tearing along the fish-hook perforations removes a tear strip comprising the top permanent seal from the remaining portion of the bag, and provides access to the packaged goods or to a reclosable seal.

The fish hook perforations can be produced with a cutting blade or knife that has a cutting surface comprising a plurality of fish hook designed edges that mirror-image the fish hook perforations of the tear line. The cutting or perforation knife according to the present invention may be a rotary or a stamping-reciprocating knife. The perforating blade may be used alone or may be combined with a sealing and cutting device, such as rotary crimping heads used for sealing and severing sealed bags from one another.

DETAILED DESCRIPTION OF THE INVENTION

Figure 1:
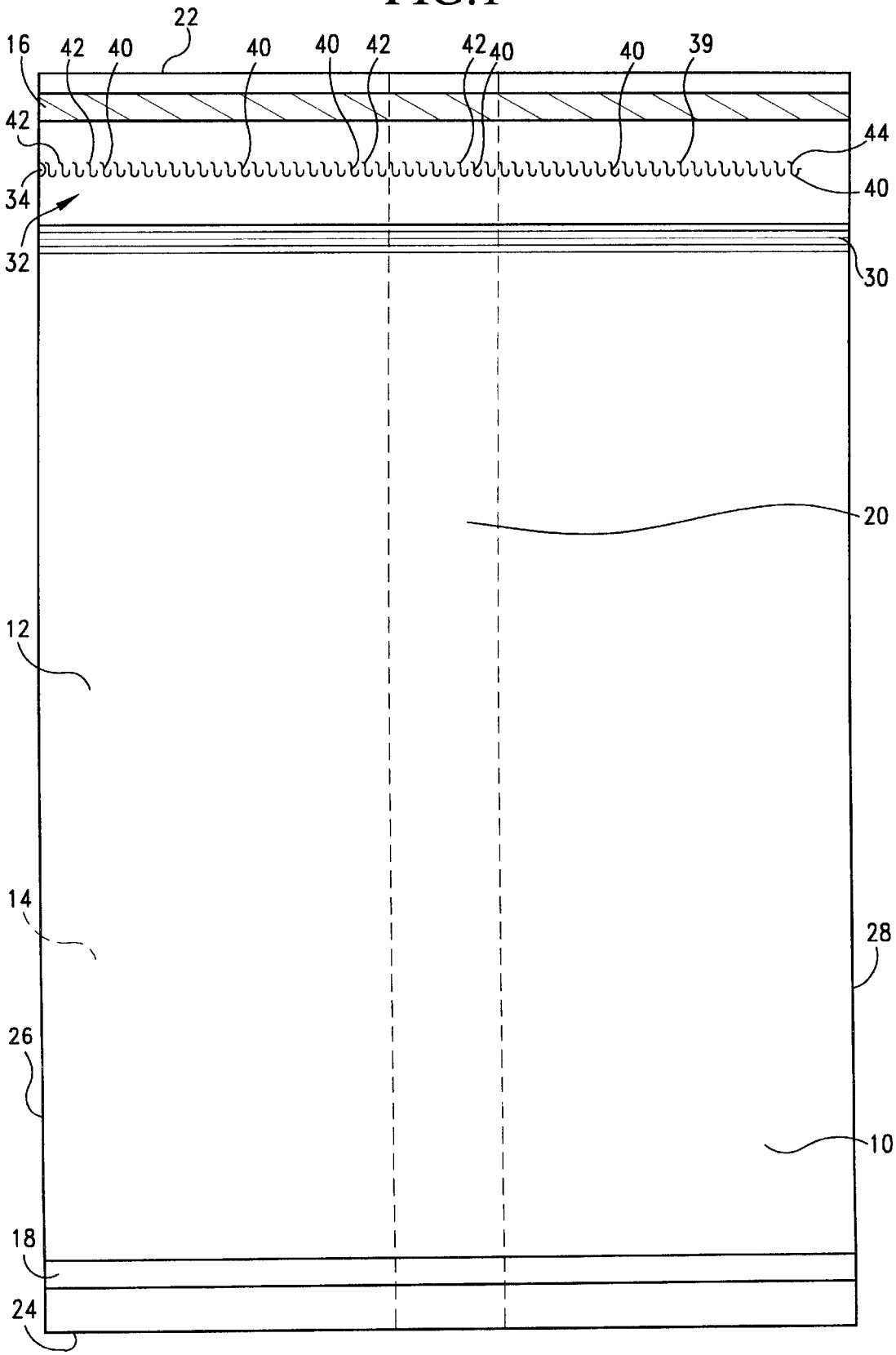
FIG. 1 is a plan view of a resealable bag having a hook design tear line according to the invention.

The present invention provides a flexible package, such as a bag or pouch, containing a closure arrangement that includes a line of weakened tear resistance, or a tear line, of specific fish hook designs. In the case of a bag, the package comprises a flexible wrapper which forms the walls of the bag. When the bag is empty, it is, usually, a flat bag comprising two wall panels (the front and back of the bag), two vertical sides, one top edge, and one bottom edge. When the bag is filled with goods, such as cookies, crackers, pasta, or trays of cookies, the bag preferably assumes a parallelepiped or rectanguliod shape with a square, rectangular or oval cross section.

The wrapper preferably comprises a flexible, food-grade wrapping material or flexible film, which may be transparent or opaque, for example, cellophane. Other materials which may be used for wrapper or film include various polymeric materials such as, for example, polyethylene, polypropylene, polystyrene, glassine, saran wrap, or other flexible packaging films, or paper. The wrapper film may comprise two or more plies of polymeric materials bonded together, or laminates with non-polymeric materials. It can also be a metallized or reinforced polymeric film, or reinforced paper.

When goods are placed inside the wrapper, the wrapper is sealed with permanent seals, such as heat seal or cold seal or other permanent seals, i.e. seals that are not resealable once opened. For example, seals on bags as made on either what is commonly referred to as a horizontal flow-through wrapper or on a vertical form-fill-seal machine are permanently sealed on the back, the top and the bottom thereby creating a sealed bag that protects the goods placed inside the bag, or for example, seals on pouches as made on what is commonly referred to as a horizontal pouch machine, are permanently sealed along both vertical edges and across the top, thereby also creating a sealed package that protects goods placed inside the package. Other flexible package configurations are possible.

The package may further comprise a resealable seal. For bags, the resealable seal is usually located below the top permanent seal. The resealable seal, preferably, extends across the bag substantially parallel to the top permanent seal. To provide access to the sealed goods, the bag comprises a closure arrangement that allows for easy removal of the top permanent seal. The closure arrangement comprises a permanent top seal and a line of weakened tear resistance, or tear line, of a specific design located below the top permanent seal. The resealable seal is located below the tear line. In the persent invention, the top permanent seal on resealable packages does not directly protect against contamination of products in the package because there are perforation cuts through the package through which contaminants can pass, and these cuts are located between the top permanent seal and the resealable seal.

The top permanent seal in resealable packages joins together the front and back pieces of the bag along the top of the bag. As a result, the top permanent seal acts to prevent the resealable seal from being opened without first removing the tear strip, thereby indirectly protecting contents of the package from being contaminated. The resealable seal protects contents of the package from contamination both during shipment and after opening and resealing the package.

The top permanent seal can be easily removed or torn off along the line of weakened tear resistance. The line of weakened tear resistance has a specific design and comprises a plurality of perforations in a form of special hooks similar to fish hooks. Such design of the perforations along the tear line assures a tear straight across the bag, avoiding undesirable cross-tearing of the bag towards the top edge or towards the bottom edge. When a tear propagates towards the top of the bag, the tear strip comprising the top permanent seal will come off in two or more pieces, which creates a nuisance to the end users. Propagation of the tear line towards the bottom of the bag renders the bag non-reclosable and useless for storage of any unused portion of the product.

According to the present invention, the special fish hook perforations or cuts are located on both opposing front and back walls of the bag so that tearing along the special fish hook perforations removes the tear strip comprising the top permanent seal from the remaining portion of the bag, and provides access to the enclosed packaged goods. In bags comprising a resealable seal, removing the top permanent seal also provides access to the reclosable seal.

The design of the special fish hook perforations causes the torn edge of the bag to have a scalloped profile, thereby providing good tamper evidence when the bag has been opened by tearing off the tear strip containing the top permanent seal.

In addition to assuring that the tear propagates straight across the bag, it is even more important that the tear line exhibit considerable resistance towards accidental tearing. Several, usually twelve, individual bags comprising loose items are usually packed in a case or carton for easier delivery to retail stores. Then the individual bags with the packed loose items are pulled from the carton and placed on shelves so that consumers may pick them from the shelves. The individual bags are often pulled from the carton by the top of the bag containing the top permanent seal, i.e. the tear strip, and if the tear line does not exhibit sufficient resistance towards accidental tearing due to pulling upward at a right angle to the perforation line, the tear strip may be accidentally pulled off during removing individual bags from shipping cases, or while consumers lift the bags from the store shelves in the same manner. Bags with torn off permanent top seals usually cannot be sold since consumers normally consider them opened or tampered with.

The perforated line of weakened tear resistance, or tear line, comprises a plurality of perforations designed in a form of hooks placed in a row along the line of weakened tear resistance. The tear line is not symmetrical, nor are the individual hooks. The hooks are placed along the line in one direction, i.e. the rounded shoulders of all hooks face one side edge of the bag and the rounded bottom, or foot, of all hooks face the opposite side edge. In embodiments of the invention, the tear will propagate in a straight line across the bag only if the tear is started from the bag side edge faced by the concave side of the hook's rounded shoulder so that the tear propagates from the tip of the free end of one hook's foot to the next adjacent hook.

Orientation of hooks in the tear line would normally be such that the direction of tear would propagate from left to right when the front panel of the bag faces the consumer and the tear strip is at the top of the bag and the front panel is oriented vertically. This arrangement accommodates most right-handed persons, although testing has indicated that most left handed persons can also readily open packages having the fish hook perforations oriented as described above. The fish hook orientation could be reversed right to left to accommodate tearing from right to left if so desired.

Testing has shown that for most packaging films, it is very difficult to start a tear where the film is folded over on itself, but it is easy to start a tear where there is a cut or notch in the film at a folded over edge. Therefore, to guide consumers to tear the perforation line in the desired direction, in this invention, the perforations are intentionally placed to intersect that vertical side of the bag where it is intended to start the tear, and the line of perforations is intentionally stopped before the perforations reach the other vertical side of the bag, providing a small gap between the last perforation and the adjacent vertical side of the bag. The gap does not contain any perforations and is usually only between approximately ⅛ inch and ½ inch, preferably approximately ¼ inch. If the gap is wider than ½ inch, when a tear propagates from the last hook in the perforation line, it might propagate either through the top permanent seal or down into the bag. If the gap is less than ⅛ inch wide, normal manufacturing tolerances could result in the gap being reduced to zero. In this case, the tear could be easily started from either end of the tear line, and the consumer might attempt tearing in a direction opposite from what the hook perforation design was intended, thereby defeating the advantages of this perforation design.

As a result of the design of the perforation line in this invention, consumers are not only inclined to start tearing the perforation line from the desired vertical side edge of the bag where it is easy to start the tear, but will find it almost impossible to start the tear from the incorrect side. In this invention, the short distance between the last perforation cut and the vertical edge of the bag prevents the consumer from tearing along the perforation line in the wrong direction.

In one optional embodiment of the invention, the perforation line does not reach the side edge of the bag where the tear line is intended to start. In this case, a notch is cut through the film and through the side edge of the bag, thereby making it easier to start a tear at the desired location.

The bag has an area below the top permanent seal in which the front of the bag is not sealed to the back of the bag. This area extends downward through the line of perforations. This unsealed area assures that the bag can be easily opened for access to the articles stored in the bag once the tear strip comprising the top permanent seal has been removed by tearing along the tear line. For resealable bags, the unsealed area extends a short distance downward past the tear line, preferably ⅜ to ¾ inches, to the resealable seal. Placing the perforation line in this non-sealed area below the permanent top seal, and providing an area of unsealed film between the line of perforations and the resealable seal, provides a section of bag where the front panel of the bag can be separated from the back panel of the bag after the tear strip has been torn off. This provides the consumer with a means to grip the front and back panels with fingers of the right and left hands to pull these panels apart in order to peel open the resealable seal.

In some embodiments of the invention, one or more dimples are embossed into either the front panel or the back panel, or alternately in both the front and back panels providing that dimples in one of the panels does not coincide or lay against a dimple of the opposing panel. Dimples are positioned so as to extend across the tear line. Dimples are formed such that the convex face of the dimple presses against the opposing panel, thereby tending to push the opposing panel away, thereby tending to cause the front panel to separate from the back panel after the tear strip has been torn off the package. This is intended to assist the consumer in separating the two panels so as to grip the panels and pull open the resealable seal or access product stored within the package.

The hook design tear line comprises a plurality of cuts or perforations in the form of hooks located along the tear line extending across the bag. While all of the cuts or perforations have a hook shape, in embodiments of this invention not all of the cuts across the line of weakened tear resistance are identical. There may be two or three different hook-shaped designs of the perforations located along the tear line. This is true for bags having either a fin type back seal or overlap type back seal, and for pouches that typically have no back seal. All three type hooks have a vertical center section that is substantially parallel to the vertical side edges of the bag, a rounded shoulder connected to the top of the vertical center section and a rounded foot connected to the bottom of the vertical center section. The rounded shoulder is connected to the vertical center section from one side of the vertical center section and the rounded foot is connected to the vertical center section from the other side, so that the rounded shoulder and the rounded foot are located on the opposite sides of the vertical center section.

In this invention, the effectiveness of the hook type perforations to direct tear propagation across the bag, rather than upward toward the top seal or downward into the bag, is largely attributed to the large top and bottom tear capture angles provided by the design of hooks and orientation of the hooks within the line of perforation.

The top tear capture angle for upright standing hooks is an angle between the horizontal center line of the line of perforations and a line extended in the general direction of tear from the tip or end of the rounded foot (or its vertical extension, if the rounded foot is extended by such an extension) to the tip or end of the rounded shoulder of the following hook. The bottom tear capture angle is an angle between the horizontal center line of the line of perforations and a line extending in the general direction of tear from the tip or the end of the rounded foot (or its extension) to a point tangent to the rounded foot of the following hook.

For inverted or upside down hooks, the bottom tear capture angle is measured as the top tear capture angle for the upright standing hooks, i.e. an angle between the center line of the line of perforations and a line extended from the tip or end of the rounded foot to the end or tip of the rounded shoulder of the following hook, and the top tear capture angle is measured as the bottom tear capture angle for the upright standing hooks, i.e. the angle between the center line of the line of perforations and a line extending from the tip or end of the rounded foot (or its extension) to a point tangent to the rounded foot of the following hook.

Increasing top and the bottom tear capture angles increases the likelihood that the tear propagating from the tip of the foot of the previous hook will be captured by the following hook perforation, and decreases the likelihood that the tear will miss the following hook perforation and propagate to the top or the bottom of the bag.

In the preferred embodiments of this invention, the tip or end of the rounded foot is oriented vertically upward. This orientation tends to direct the tear somewhat upward while the tear strip is pulled horizontally in the general direction of the tear strip removal. If the tear strip is torn off the bag by pulling it horizontally to the right across the bag, the tear propagation will be somewhat upward from horizontal and toward the right until the tear reaches the next hook perforation. If the tear strip is pulled somewhat upward and to the right, the tear will tend to propagate upward to the right at an upward angle somewhat greater than the angle of pulling. If the tear strip is pulled somewhat downward and to the right, the tear will tend to propagate horizontally to the right or slightly upward to the right. If the tear strip is pulled steeply downward to the right, the tear will tend to propagate downward to the right, but not as steeply downward as the direction of pull. Because of this relation of the angle of tear propagation to the angle of pull, top tear capture angles need to be greater than bottom tear capture angles in order to provide satisfactory package performance.

To remove the tear strip, consumers rarely pull the tear strip directly across the bag horizontally. They usually pull it in a somewhat upward or somewhat downward direction and to the right. The hooks are designed in a way that even though the tear exiting the tip of the rounded foot of one of the hook perforations may propagate somewhat upward or downward, the next hook perforation will capture the propagation and divert it from propagating to the top or the bottom of the bag. The greater are the tear capture angles the greater is the likelihood that the tear will be captured by the following hook perforation and, therefore, that the tear will propagate across the bag rather than to the top or the bottom of the bag.

The top tear capture angle can be varied by varying the length of the rounded shoulder, or the extension of the rounded shoulder if the rounded shoulder has such an extension, and/or by varying the length of the vertical extension of the rounded foot, if the rounded foot has such an extension. The bottom tear capture angle can be varied by varying the length of the vertical extension of the rounded foot. Top tear capture angles can also be varied by changing the heights of the vertical center section of the hooks. Varying the tear capture angles by increasing the length of the rounded shoulder or/and the extension of the rounded foot will respectively shorten the horizontal and vertical gaps between the hooks, thus reducing the amount of tie material, where tie material is the film between hooks along the tear line, and thus reducing resistance of the tear line to the accidental tear-off as described above for pulling bags from shipping cases.

Furthermore, the spacing of the hooks will inversely affect the tear capture angles, i.e. the smaller the distance between hooks, the larger the tear capture angles, and the larger the distance between hooks, the smaller the tear capture angles. Also, the larger the space between hooks, the greater the resistance to accidental tear-off, and the smaller the distance between hooks, the lesser the resistance to accidental tear-off. Therefore, the choice of the capture angles, the length of the rounded shoulders and/or their extensions, the length of rounded feet and/or their extensions, the length of the vertical center section, and the tooth spacing must be balanced to achieve the desired combination of resistance to accidental cross tear propagation toward the top or bottom of the bag, and resistance to accidental tear-off of the tear strip.

Increasing the bottom tear capture angle by increasing the length of the vertical extension from the rounded foot will decrease the top tear capture angle unless the vertical section between the rounded shoulder and the rounded foot is also increased. Increasing the top tear capture angle by increasing the height of the vertical center section between the rounded shoulder and the rounded foot, or increasing the bottom tear capture angle by increasing the vertical extension of the rounded foot and consequently also increasing the vertical center section by an equal amount to prevent a corresponding reduction of the top capture angle, should be balanced against additional expense that is brought to the cost of the bag by higher hooks.

Increasing the height of the hooks requires that both the vertical height of the bag and the vertical length of the film be increased by the same amount that hook height is increased. Increasing the height of the hooks, therefore, requires a greater amount of film, thus increasing the cost of the bag, which should be taken into consideration during designing of the hooks.

In embodiments of this invention, the majority of fish hook type perforations, or cuts through the packaging film, would be of a first fish hook or main hook design. To assure straight line propagation of the tear across the bag and to prevent cross tearing, or propagation of the tear towards the top or the bottom edges of the bag, main hooks are designed to maximize top and bottom tear capture angles.

In embodiments of this invention, main hooks are horizontally spaced from each other so that there is a small horizontal gap between hooks. The uncut film between the hooks is called a "tie". The tie joins the tear strip, containing the top permanent seal, to the main body of the bag. Testing has shown that packaging film exposed to a tension force provides considerably more resistance to tearing than does packaging film exposed to shear forces. Therefore, main hooks in this invention have been designed and arranged to have a horizontal gap between them that provides an uninterrupted vertical tie between the tear strip and the main body of the bag, thereby providing more resistance to accidental tear-off than hooks, or other shaped perforations, that have no horizontal gap between perforations, or little or no uninterupted vertical section within the tie between the tear strip and the main body of the bag.

In this invention, the combination of hook width and hook spacing for main hooks is designed to provide good resistance to accidental tear-off, as previously described for when a bag is being pulled from a shipping case, while still maintaining good tear capture angles, as described below.

The width of main hooks, measured horizontally, is determined by the radius of the rounded foot and the radius of the rounded shoulder. The radius of the rounded foot should be as small as practical from a manufacturing standpoint, but not so small as to cause a stress point in the film at the very bottom of the foot during removal of the tear strip, that could cause a tear to propagate from that stress point down into the bag rather than propagating from the tip of the rounded foot across to the next adjacent hook. A rounded foot radius of 0.030 inches has been found to be practical from a manufacturing standpoint, and not to be small enough to cause a stress point in the film prone to tear propagation downward toward the bottom of the bag. Functionally, the radius of the rounded shoulder could be smaller than that of the rounded foot without causing a stress point in the film that would be prone to tear propagation. However, for manufacturing efficiencies, it is preferred that the radius of the rounded shoulder be made to match the radius of the rounded foot.

In embodiments of this invention, the tear line is not symmetrical, nor are the individual hooks. The hooks are placed along the line in one direction, i.e. the rounded shoulders of all hooks face one side edge of the bag and the rounded foot of all hooks faces the opposite side edge. The tear will propagate in a straight line across the bag only if the tear is started from the side edge of the bag that is faced by the hook's rounded shoulder. In this direction, the tear propagates from the free end of the rounded foot of one hook to the next hook. If the tear is started from the opposite side of the bag, i.e. the side faced by the rounded foot of the hook, the propagation of the tear will have a tendency to miss the next hook and instead propagate up and through the permanent top seal, since the top tear capture angle, as described below, in this direction is only approximately zero degrees and is therefore not sufficient to capture the tear propagation toward the top of the bag.

The tear capture angles that provide high likelihood of straight-line tear propagation in the desired horizontal direction vary considerably depending on the material of the bag. Films produced from different materials have different tear resistance, and different directional tear resistance, i.e. horizontally or vertically. Also, films may be reinforced increasing the tear resistance of the film, thus reducing chances of accidental tear-off. Sometimes polymeric films utilized in production of bags may be of oriented construction and have a built in tendency to guide the tear in the direction of the film's orientation. Therefore, the minimum values of the desired tear capture angles required for acceptable bag performance are somewhat dependent on the material of the bag.

As a general rule, the top tear capture angle for upright standing hooks should be greater than about 50°, preferably greater than about 55°, and most preferably between 60° and 70°. Likewise, the bottom tear capture angle should be greater than about 15°, preferably greater than 20°, and most preferably between 25° and 30°. In general, height of hooks should be from about 0.08 to 0.20 inch, preferably about 0.10 inch. The radii of the rounded feet should be greater than about 0.025 inch and smaller than about 0.050 inch, preferably about 0.030 inch.

Although the size, proportions and spacing of the hooks in this invention can be varied from what is stated below and still provide good package performance, or in some cases might even provide slightly improved package performance, the below described configuration has proven to provide exceptionally good overall package performance, and is the preferred configuration of this invention.

It has been determined that main hooks that are 0.10 inch high, having 0.030 inch foot and shoulder radii, having a 0.015 inch vertical extension from the tip of the foot, and spaced 0.120 inches apart horizontally, center to center, i.e. the distance between the vertical center section on one hook to the vertical center section of the next adjoining hook, provides both good tear capture angles and good resistance to accidental tear-off of the tear strip. This hook configuration provides downward tear capture angles of in excess of 28°, upward tear capture angles in excess of 62°, ties that amount to 50% of the horizontal distance measured along the tear line, and vertical tie material exposed to pure tension, when the tear strip is pulled vertically upward, that amounts to 25% of the horizontal distance measured along the tear line.

To achieve good package performance, at least the majority of the fish hook perforations in a tear line must comprise a vertical center section between the rounded shoulder and the rounded foot, which is substantially parallel to the side edges of the bag and substantially perpendicular to the top and the bottom edges of the bag. Such hooks will provide greater tear capture angles than hooks not having vertical center sections. Furthermore, hooks having vertical center sections provide greater bottom tear capture angles than hooks having the same top tear capture angles but having center sections that are slopped downward in the general direction of tear, due to the resultant smaller horizontal distance between feet of adjacent hooks that have vertical center sections.

Furthermore, if each of the hooks in a tear line having vertical center sections all have the same radius rounded shoulder, the same radius rounded foot, and the same horizontal gap between hooks, those tear lines comprising hooks that each also have a vertical extension attached to the free tip of the rounded foot will provide greater bottom tear capture angles than those having hooks that do not have vertical extensions from each of their rounded feet.

Furthermore, when hooks are substantially closer together, as is possible for hooks with vertical center sections, the top and bottom tear capture angles are substantially greater. Therefore, bags having hook perforations with vertical center sections between rounded shoulders and rounded feet will provide substantially greater top and bottom tear capture angles than perforations having the same resistance to accidental tear-off but having center sections that are slopped downward in the general direction of tear. The resultant larger tear capture angles attributed to hooks with vertical center sectons results in higher probabilities for straight tears across the bag as well as reduced probability of a tear propagating either out the top of the bag or down into the bag, while maintaining a high resistance to accidental tear-off, thus improved overall package performance.

Main hook perforations of this invention, which have a vertical center section, whether or not a vertical extension of the foot is included, will provide significantly greater resistance to accidental tear-off than non-overlapping sideways placed "Z" perforations or "S" perforations, or "~" perforations due to the greater ratio of unperforated film to perforated film provided along the tear line by main hooks for any given bag width. Likewise, they will provide significantly greater resistance to accidental tear-off than overlapping sideways placed "Z" perforations or "S" perforations, or "~" perforations due to the main hooks as described providing a tie that is vertically uninterrupted between the top permanent seal and the main body of the bag, whereas overlapping sideways placed "Z" or "S" perforations, or "~" perforations provide no tie material that is vertically uninterrupted.

For these reasons, bags having hooks with non-vertical center sections sloping downward in the direction of tear, such as tilted or placed sideways "Z" or "S" shaped perforations, or" ~ shaped perforations do not provide adequate resistance to accidental tear-off, as when bags are pulled from a shipping case.

Furthermore, sideways "Z" or "S" shaped perforations, or "~" shaped perforations do not provide sufficient top and bottom tear capture angles to adequately prevent cross tearing towards the top and the bottom edges of the bags due to very small tear capture angles as measured either in the upward direction or downward direction from the tear line, or measured in both directions.

I this invention, some of the hook perforations along the tear line are type #2 hooks. These are basically the same shape as main hooks, except they have a horizontal extension, or arm, extending from the very end of the top shoulder. This arm is substantially parallel to the top or the bottom edges of the bag. The space between type #2 hooks, measured center to center, is intended to be the same as the distance between the main hooks, but the arm of type #2 hooks is to slightly overlap horizontally with the free end of the rounded foot of the previous hook, or its vertical extension.

As mentioned earlier, it is very difficult to start a tear in flexible packaging films as used in the types of packages described in this invention if that film is folded over on itself, as naturally occurs at the intersection of the bag's front and back panels and where the back fin seal joins the back panel.

If only main hooks are used, the likelihood would exist that due to normal manufacturing tolerances, where the line of perforations crosses that edge of the bag where a tear is intended to start, sometimes the uninterrupted vertical tie between main hooks, rather than the perforation, will intersect the folded edge of the bag. In these cases, there would not be a cut through the folded edge, and it therefore would be difficult to start the tear required to remove the tear strip.

In this invention, the design and horizontal overlap of the type #2 hooks, and the placement of type #2 hooks across that edge of the bag intended as the edge where intentional tearing is to start, assures that there is always a cut through that edge of the bag. This assures that the consumer can always easily start an intentional tear to remove the tear strip.

Alternately, if only main hooks are used, a notch could be provided at the edge of the bag at a location vertically in line with the tear line to assure an intentional tear could be easily started in the correct location even if the uninterrupted tie between main hooks happens to intersect the side edge of the bag. However, accurately locating a notch in the correct position in a high-speed production environment can be very difficult, especially when bags are being produced in the most common manners, i.e. on horizontal wrapping machines or on vertical form-fill-seal machines. The use of type #2 hooks at this location eliminates the need for a notch, and therefore eliminates the problems associated with using notches.

A fin type back seal is usually a vertical permanent seal extending from the bottom of the bag to the top of the bag. The "fin" of the fin type back seal naturally extends free from the back panel of the bag, is usually approximately ¾ inch long measured horizontally, and is normally folded over to lay flat against the back panel. At the point where a fin type back seal joins or intersects the bag's back panel, the packaging film is naturally folded over on itself.

As previously stated, it is very difficult to start a tear in a piece of film that is folded over on itself. If only main hooks are used, the uninterrupted vertical tie that exists between main hooks could result in no cut through this intersection of the fin seal with the back panel of the bag. Should this happen, tear propagation through the fin seal could be difficult, and control of tear propagation could be lost, resulting in the tear propagating either upward through the top permanent seal or downward into the bag.

The use of type #2 hooks at that intersection assures that the film will be cut at the point where fin type back seal intersects the bag's back panel. This will assure that when the tear reaches the fin seal, it will easily continue to propagate straight across the bag to the next hook. For bags having overlapped type back seals, the type #2 hook design can optionally be used across the seal. This is not essential, but will provide improved control of tear propagation across the seal especially if there is a small area along the leading edge of the overlapped seal that is not actually sealed.

For bags having fin type back seals, to assure that a tear propagating along the tear line will continue to propagate straight across the bag when the tear reaches the back seal, the fin of the fin seal must be folded such that the tear starts at the root of the fin, i.e. where the fin joins the back panel, and propagate toward the free edge of the fin. To attempt to tear the fin starting at the loose edge of the fin is likely to cause loss of control of the direction of tear propagation, and can cause the tear to propagate toward the top or bottom of the bag. Therefore, it is important that the back fin seal and the orientation of its fin be designed and manufactured such that tear propagation direction as determined by the design of the hooks in the perforation line will naturally progress across the fin seal starting at that point where the fin joins the back panel.

One special hook perforation, type #3 hook, is located at the very end of the line of perforations. In this invention, type #3 hook is similar in design to main hooks, but rather than having a vertical extension extending from the rounded foot, it has a rounded elbow extending from the tip of the rounded foot. This rounded elbow can be of any desired radius, but for manufacturing convenience, it can be of the same radius as that of the rounded foot. This elbow passes through substantially 90° rotation and is oriented such that its free end or tip points horizontally in the direction of intended tear propagation. This orientation will tend to direct tear propagation horizontally from this tip toward the adjacent side edge of the bag.

A short horizontal side arm, substantially parallel to the top edge of the bag, can be connected to the free end of the elbow to enhance the tendency of the tear to propagate horizontally to the side of the bag. The type #3 hook is optional, as is its horizontal arm, and is placed last at the end of the line of perforations to help direct the tear horizontally from the last hook cut through the small distance of non-perforated film between the last hook perforation cut and the outer side edge of the bag.

In embodiments of this invention, the tear line may have hooks that are in upright position, i.e. upright hooks with the rounded shoulder located closer to the upper edge of the bag and the rounded foot located closer to the bottom edge, or the hooks may be inverted, i.e. with the round foot of the hook up and located closer to the top edge of the bag. The hooks may also vary in design, for example, the hooks may be of a different height, may have rounded feet or rounded shoulders of different radii, and they may also have a vertical extension at the end of the rounded foot. However, all of the hooks in one tear line are of substantially the same heights, and are all of substantially the same design with variations for the arms in type #2 hooks, and elbow and arms for type #3 hooks as discussed above. Also, all the hooks in the same tear line are either upright hooks or inverted hooks.

The number of the hooks for any particular bag width depends on the design of the hooks, especially on the radius of the curvature of the rounded foot and rounded shoulder as previously described, and the spacing of the hooks. For the bags of different width, usually only the quantity of main hooks will vary. The bag, regardless of its width, still should have the same number of type #2 hooks at the beginning of the tear line, in the middle of the tear line where the tear line crosses the root of the fin type back seal, or optionally for an overlap type back seal, and optionally one type #3 hook at the end of the perforated line.

In an embodiment of this invention, the vertical central section of the fish hook perforation could tilt slightly backwards, i.e. slope downward opposite the direction of intentional tear propagation. Properly configured, this could increase the tear capture angle from the tear line down toward the bottom of the bag, without decreasing the tear capture angle toward the top permanent seal, and at the same time could increase resistance to accidental tear-off due to the greater ratio of unperforated film to perforated film provided horizontally along the tear line by backward tilting center sections.

In flexible packaging films, the hook perforation designs embodied in this invention are superior to all other known perforations, in that these designs provide better resistance during opening to unintentional cross tearing up through the top of the bag and down into the bag, and also provide better resistance to unintentional tear-off of the tear strip as might occur from lifting packages by their tops, or pulling individual bags by their tops to remove the bags from shipping cases.

According to some of the preferred embodiments of the present invention, the bags are resealable bags comprising a resealable seal located below the line of weakened tear resistance and extending across the wall panels of the bag.

It is important that at least a majority of the fish hook perforations comprise a vertical center section, major axis, or major central portion which is substantially perpendicular to the perforation line or desired direction of propagation of the tear line. For example, for a rectangular-shaped bag, a majority of the fish-hook perforations preferably comprise a vertical center section or major central portion which is at least substantially parallel to the side edges of the bag and substantially perpendicular to the top and the bottom edges of the bag. The major or longitudinal axis of each such perforation is substantially parallel to the major axis of all other such perforations, and substantially perpendicular to the perforation line, or center line of the perforations. Hooks having their major central portion oriented vertically can be placed closer together, thereby providing much better results in straight line tearing, while maintaining high resistance of the tear line to accidental tearing.

According to some of the preferred embodiments of the present invention, the bags are resealable bags comprising a resealable seal located below the line of weakened tear resistance and extending across the front and back wall panels of the bag. The resealable seal may be of a conventional zip-lock profile type or other interlocking profiled reclosable seal, or it may be a strip of resealable adhesive applied to either of the inside surface of the front panel or of back panel of film, or to the inside surface of both the front and back panels. It may also be a strip of resealable cold-seal as may be applied during conversion of the wrapper film, or it may be a strip of pressure sensitive tape applied to the outside face of the wrapper film with part of the adhesive surface exposed through a slot in the bag so that the tape on the panel having the tape adheres through the slot to the opposite panel, thereby sealing the front panel to the back panel. The reclosable seal may also be a tamper evident seal.

The invention further provides for a perforation or a cutting knife or blade and apparatus which are utilized to provide flexible bags with hook designed lines of weakened tear resistance or tear lines. The perforation knife may be a conventional rotary or reciprocating stamping type knife or cutter, or any other type knife or cutter used in industry for production of perforated lines in flexible bags which is modified to provide a cutting edge which imparts a line of the hook-shaped perforations of the present invention.

The perforating knife or cutting apparatus of the present invention comprises a blade having a plurality of cutting edges shaped in the form of hooks or fish hooks, or cutting hooks arranged in a straight line or a row. The cutting hooks mirror the hook perforations in the tear line. The design and size of the cutting hooks in the perforation cutting knife correspond to the design and size of the hook perforations in the line of weakened tear resistance. A complete row of cutting hooks in the knife corresponds to a duplicate of the perforated line of weakened tear resistance. For example, most of the cutting hooks along the blade would be of a first type corresponding to the perforations in the form of the first or main hooks in the tear line. The knife may further comprise several cutting hooks of a second type, or type #2 hooks, corresponding to the perforations of the form of the type #2 hooks at the beginning of the blade and in the middle of the blade. One optional cutting hook of a third type, or type #3 hook, corresponding to the perforation in the form of the third hook, or type #3 hook, may be present at the end of the blade.

Furthermore, if the knife were to cut the film from the face of front of the bag, the complete row of cutting hooks would be a mirror image of the perforated line of weakened tear resistance.

The knife can be modified to have a different number of different cutting hooks along the blade. For example, a knife may not have any type #2 cutting hooks in the middle of the blade, or may have a few extra type #2 hooks at the beginning of the blade, or may have several type #2 cutting hooks at the end of the blade. The type #2 cutting hooks are to be placed anywhere along the blade where the blade is intended to perforate through a section of wrapper film where a tear is intended to start, i.e. at the leading edge of the bag, or where the tear intersects a hinge as would be created by folding a fin seal over against a panel of the bag, or where the tear intersects the leading edge of a piece of film that is not folded as would be created by producing an overlap seal on the back panel of the bag. In the preferred embodiments, at least two of the type #2 cutting hooks are located at one of end or side edge of the cutting knife.

The number of the cutting hooks in a cutting row may be the same as the number of perforations in the tear line, or it may have one or more extra cutting hooks, usually type #2 hooks, to assure that the perforations extend across the edge of the bag where the tear is intended to start.

The perforation or cutting knife or blade of the present invention may be used separately or may be combined with rotary or stamping type sealing and cutting devices, such as crimping and sealing heads or jaws, conventionally used in horizontal or vertical flow-through wrapping machines. In preferred embodiments, the perforation blade is combined with crimping and/or sealing heads. Examples of wrapping form and seal machines that utilize stamping or rotary sealing and cutting heads are known in the art and disclosed, for example in U.S. Pat. Nos. 3,850,780, 3,943,686, 4,106,265, 4,712,357, 4,909,016 and 5,678,390, the disclosures of which are herein incorporated by reference in their entireties. The sealing heads may be of the crimping type, i.e. with sealing surfaces that produce wavy crimped seals, or may be of the smooth type that produce smooth seals.

Sealing, crimping and cutting heads comprise a pair of opposed sealing heads for sealing the flexible material between the packaged articles and cutting the wrapping between the sealed articles. The first crimping and sealing head comprises two sealing and crimping surfaces and a knife blade located between the two crimping surfaces and extending beyond the crimping surfaces. The second crimping and sealing head comprises two sealing surfaces that are complementary to the crimping surface of the first crimping surfaces, and an anvil between the sealing surfaces that is complementary to the knife on the first sealing head, for backup of the film to allow the knife blade to sever the wrapping material between the seals through a cutting or crushing action.

The perforation knife according to the present invention is placed on the first crimping and sealing head and is located adjacent to one of the crimping surfaces. The second crimping and sealing head comprises an anvil or resilient pad adjacent to the crimping surface and complimentary to the perforation knife on the first sealing head for backup of the film to facilitate penetration of the perforation blade through the film through a cutting or crushing action. The perforation knife may be located immediately adjacent to the crimping surface or may be separated from the crimping surface by a small distance. The exact position of the perforation knife depends on the design of the knife and the desired position of the perforated line on the bag. For heat seal film, the perforation knife and complementary anvil are usually separated from the crimping and sealing surfaces by an air gap, or other insulator, to prevent heat within the sealing head from migrating to and sealing the front and back panels of the package together in the area of the perforation cuts.

For bags having reclosable seals, the crimping and sealing heads may, in addition, comprise a pair of resilient pads for closing the resealable seal. The resilient pads are located one on each of the crimping heads and adjacent to the perforation blade and the anvil/pad that is complementary to the perforation blade. In the preferred embodiments, the sealing, cutting and perforating heads are of a rotary type comprising two counterrotating heads.

Figure 2:
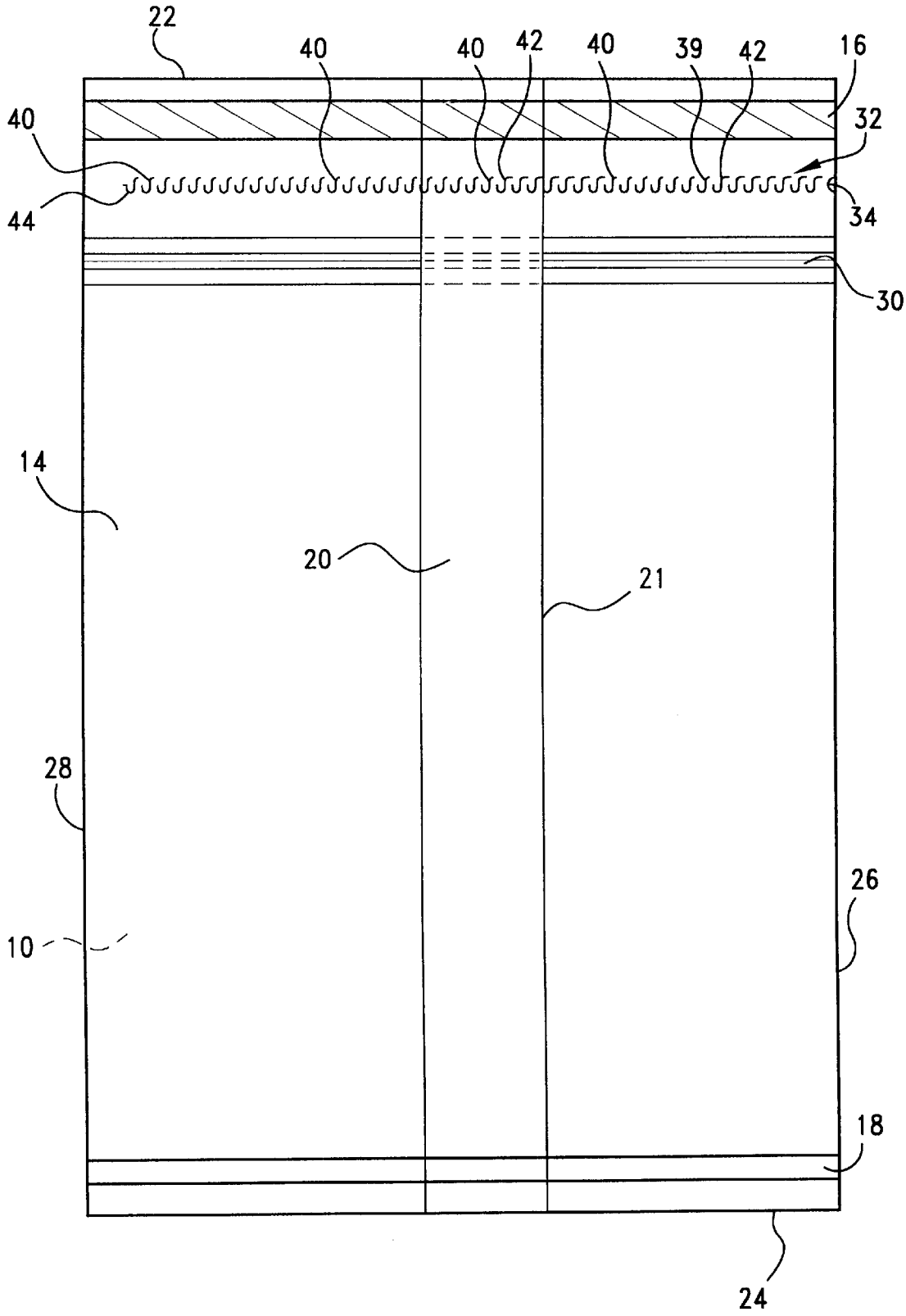
FIG. 2 is a rear view of the bag according to the invention.

Referring now in detail to the drawings, an empty bag or pouch 10 according to one of the embodiment of the present invention is shown in FIGS. 1 and 2. It has two opposing wall panels 12 and 14 made from a thin plastic, heat sealable film. The first or the front wall panel 12 and the second or the back wall panel 14 are secured together by a permanent heat seal 16 at the top of the bag and a permanent seal 18 at the bottom of the bag. The top seal 16 is usually a heat seal, but it may be a cold seal. The first wall panel 12 and the second wall panel 14 may be welded together by a heat seal or bonded together by an adhesive at the bottom seal 18.

The wall or back panel 14 has a substantially central joint 20 (FIG. 2) that extends vertically along the back panel 14 from top edge 22 to the bottom edge 24. The central or fin joint, or fin seal 20 is formed by securing or welding the edges of the film together, preferably utilizing approximately ¾ inch of film along each film edge extending from the top edge 24 of the bag to the bottom edge 26 of the bag. This fin joint is then folded substantially flat against back panel 14, thereby forming a hinge 21. The joint 20 is secured on the top and the bottom in the position adjacent and substantially parallel to the back panel 14 by permanent heat seals, 16 and 18 which secure the wall panels 12, 14 and the joint 20.

The side edges 26 and 28 are formed by folding over wrapper film onto itself to form the wall panels 12 and 14. The wall panels 12 and 14 are formed integrally, with wall panel 14 comprising the central joint 20.

Spaced from the permanent seal 16 down towards the bottom permanent seal 18 is a resealable or reclosable inner seal 30. The resealable inner seal 30 extends from one side edge 26 of the bag to the other side edge 28 substantially parallel to the permanent seals 16 and 18.

A line of weakened tear resistance or tear line 32 is formed between the permanent top heat seal 16 and the resealable seal 30 and is substantially parallel to both seals 16 and 30. The line of weakened tear resistance, or tear line, 32 extends across and through both opposing wall panels 12 and 14 of the bag. The line 32, as shown in greater detail in FIG. 3A extends from one side edge 26 and stops short of reaching the other side edge 28 of the bag to minimize the risk of a consumer tearing the tear line in direction opposite to what is intended by the design of the perforation line. In some of the embodiments, where the tear line 32 does not extend to edge 26, the bag may also comprise an edge notch 34, as shown in detail in FIG. 3B, located at the beginning of the tear line at bag side edge 26, to insure that the tear begins and occurs at the desired location.

The line of weakened tear resistance 32 comprises a series of cuts or perforations shaped in a form of fish hooks 39. The bag may further comprise one or more dimple depressions 38 in the first or front wall panel 12 located at the middle of the wall panel 12 between the permanent seal 16 and the resealable seal 30, and overlapping the line of weakened tear resistance 32, to facilitate separation of the first and the second wall panels 12 and 14 for easy opening of the bag 10. Alternately, the dimple depressions may be in the second or back wall 14 between the permanent seal 16 and the resealable seal 30 to facilitate separation of the first and the second wall panels 12 and 14 for easy opening of bag 10, or may be in both the front paned 12 and back panel 14.

Figure 3A:
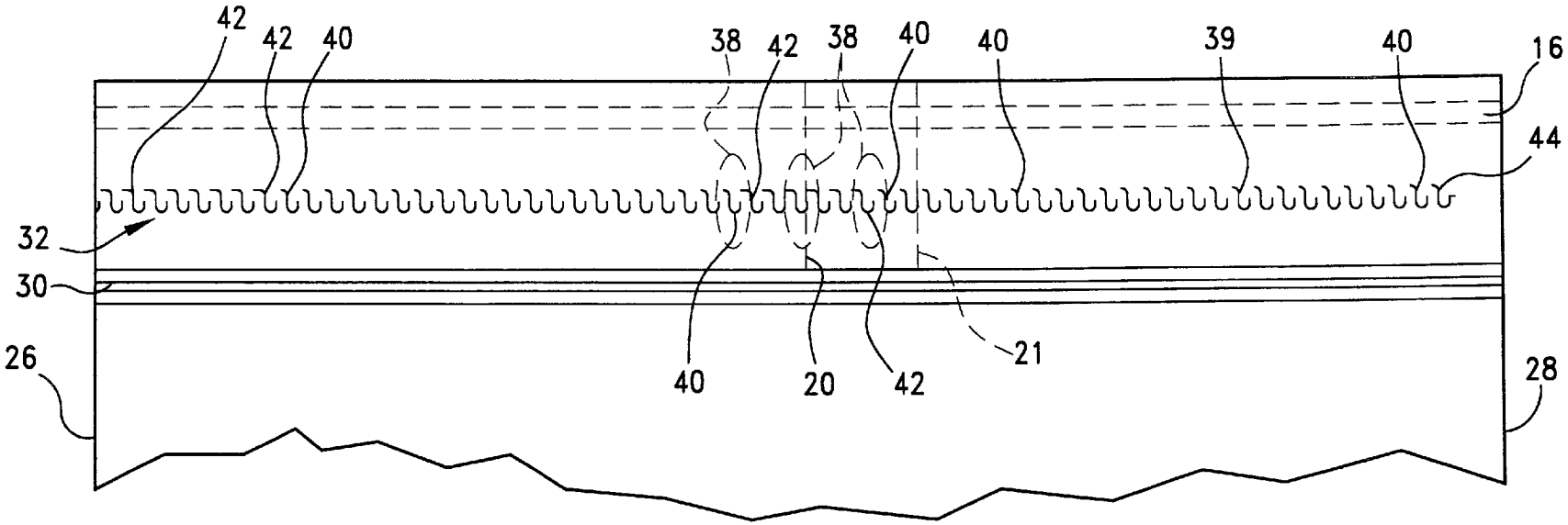
FIGS. 3A and 3B are plan views of the top portion of a bag according to the invention, with a closure arrangement, and with a preferred and optional tear line design respectively.
Figure 3B:
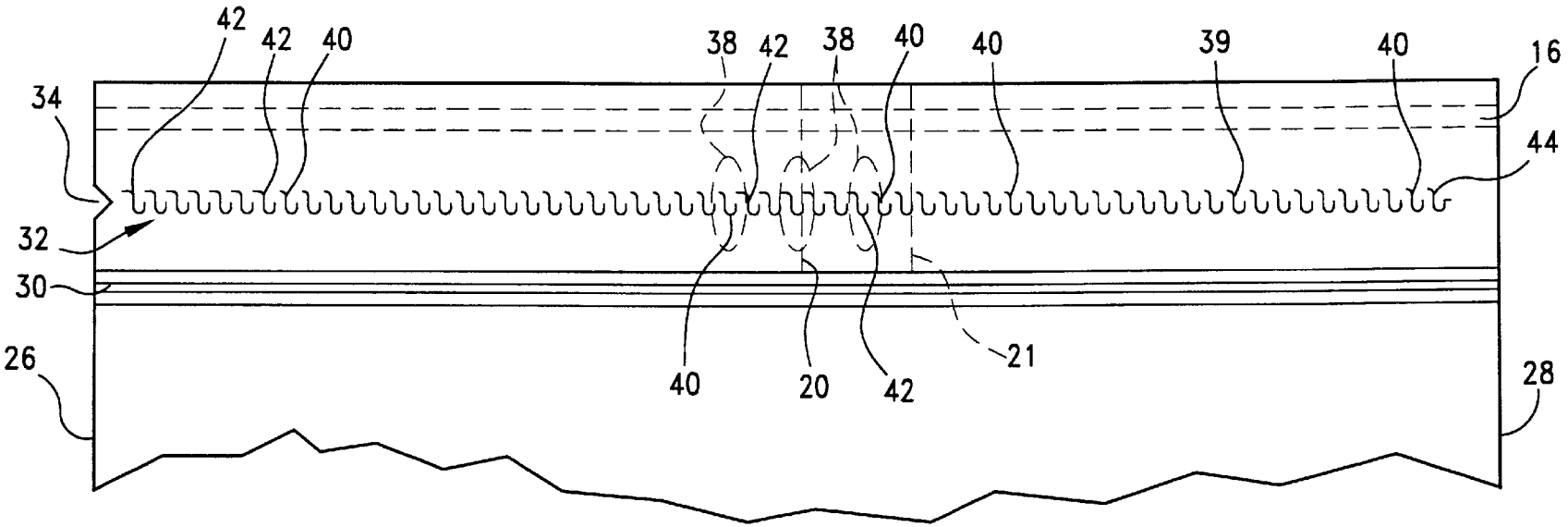
Figure 4A:
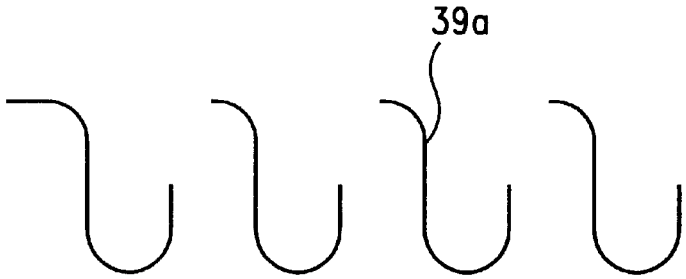
FIGS. 4A, 4B, and 4C are enlarged views of portions of tear lines having hookshaped perforations according to the invention.
Figure 4B:
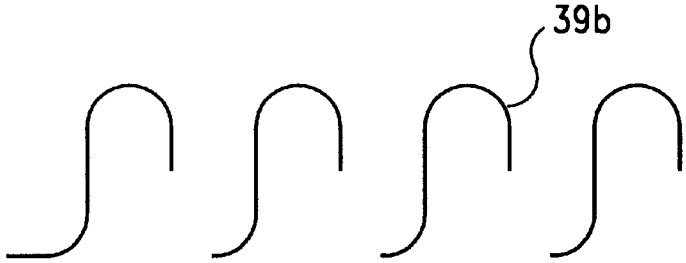
Figure 4C:
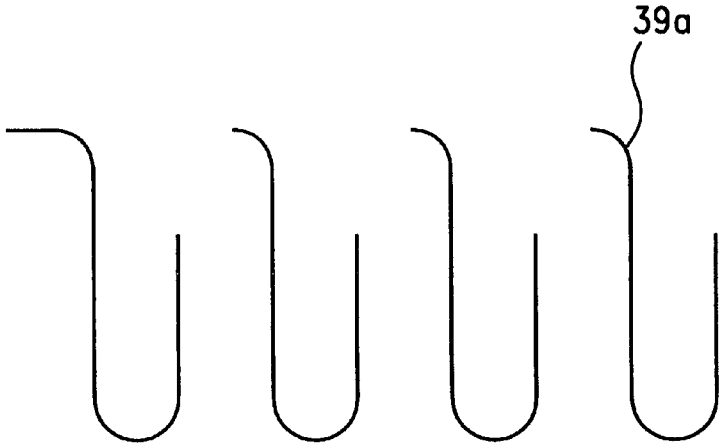

As shown in FIGS. 1, 3A, 3B, 4A, 4B, and 4C the fish hook perforations 39 can be of different designs, such as different heights, and can be upright hooks 39*a* or inverted hooks 39*b* as shown in FIGS. 4A and 4B.

Figure 5A:
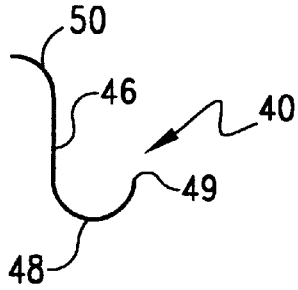
FIGS. 5A, 5B, and 5C are enlarged views of three hook perforations according to the invention.

Each tear line 32 comprises a number of first or main hook cuts or perforations 40, second hook cuts or perforations 42 and, optionally, a third hook cut or perforation 44. As shown in FIG. 5A, each first hook perforation 40 comprises a vertical center section or major central portion 46, a rounded hook bottom or foot 48, and a rounded shoulder 50 at the top of the hook.

Figure 5B:
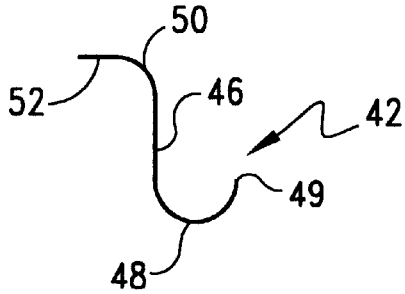

In the preferred embodiment the tear line additionally comprises several second hooks 42 as shown in FIG. 5B that, in addition to the vertical center section 46, rounded foot 48 and rounded shoulder 50, further comprise a top or first arm 52 that is connected to the top of the vertical center section 46 through the rounded shoulder 50.

Figure 5C:
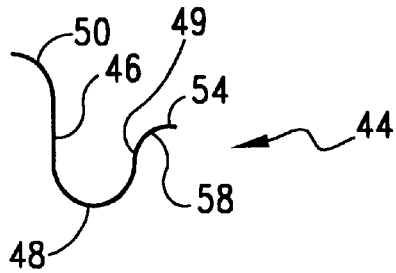

One optional third hook, or type #3 hook 44 as shown in FIG. 5C, that is usually the last hook of the tear line 32 comprises, in addition to a rounded foot 48, a vertical center section 46, and a rounded shoulder 50, a side arm 54. The side arm 54 is connected to the end 49 of the rounded foot 48 through rounded elbow 58. Both arms 52 and 54 are substantially parallel to the top 22 and bottom 24 edges of the bag 10 and the center line of the perforations.

As shown in FIGS. 1, 3A and 3B a plurality of the type #2 hooks 42 comprising the top arm 52 are located at the very beginning of the tear line 32 at bag side edge 26, and in most embodiments of this invention, preferably intersect bag side edge 26. A plurality of type #2 hooks 42 are also located in the middle of the tear line 32 and extend across the portion of the wall panels 12, 14 in the area adjacent to the central hinge 21, extend somewhat to both sides of hinge 21, preferably ¼ to ½ inch, and intersect hinge 21. Preferably, the hooks 42 are positioned adjacent to each other, or adjacent to a hook 40, as occurs where the tear line approaches the hinge in the fin seal, in such a way that top arm 52 horizontally overlaps the end 49 of rounded foot 48 of the previous adjoining hook 42, or previously adjoining hook 40 if preceded by a hook 40. This positioning of type #2 hooks 42 relative to each other, and to hook 40 at the fin seal, along with positioning a plurality of hooks 42 across bag side 26 and hinge 21 assures that the film will be cut across bag side 26 and across hinge 21.

Such arrangement and design of the type #2 hooks 42 assures that the tear starts in the desired place relative to the top seal, i.e. along the line of weakened tear resistance, assures a straight tear at the beginning of the tear line 3, and assures that the tear will propagate through hinge 21 without tearing in the longitudinal direction (towards the top edge 22 or bottom edge 24) of the bag 10.

The design of the last hook, type #3 hook 44, comprising side arm 54, facilitates the complete removal of the top permanent seal 16 from the remainder of the bag 10 by directing the tear to propagate substantially horizontally through the short distance between arm 54 and the bag side 28.

A majority of the hooks 39 in a tear line 32 are first or main hooks 40. First or main hooks 40 are placed and designed to provide a combination of maximum resistance to accidental tearing, and maximum guidance of the propagating tear straight across the bag 10 to minimize longitudinal tearing of the bag 10. To assure the maximum balance between the desired properties, the distance between the first hooks 40 and the top and bottom capture angles are carefully chosen, usually depending on the type of the material of the bag 10. FIG. 3A also shows dimples 38, which are embossed into either the front panel 12 or the back panel 14, or alternately in both the front and back panels. Dimples are formed such that the convex face of the dimple presses against the opposing panel, thereby tending to push the opposing panel away, thereby tending to cause the front panel 12 to separate from the back panel 14 after the tear strip has been torn off the package. This is intended to assist the consumer in separating the two panels so as to grip the panels and peel open the resealable seal 30.

Figure 6:
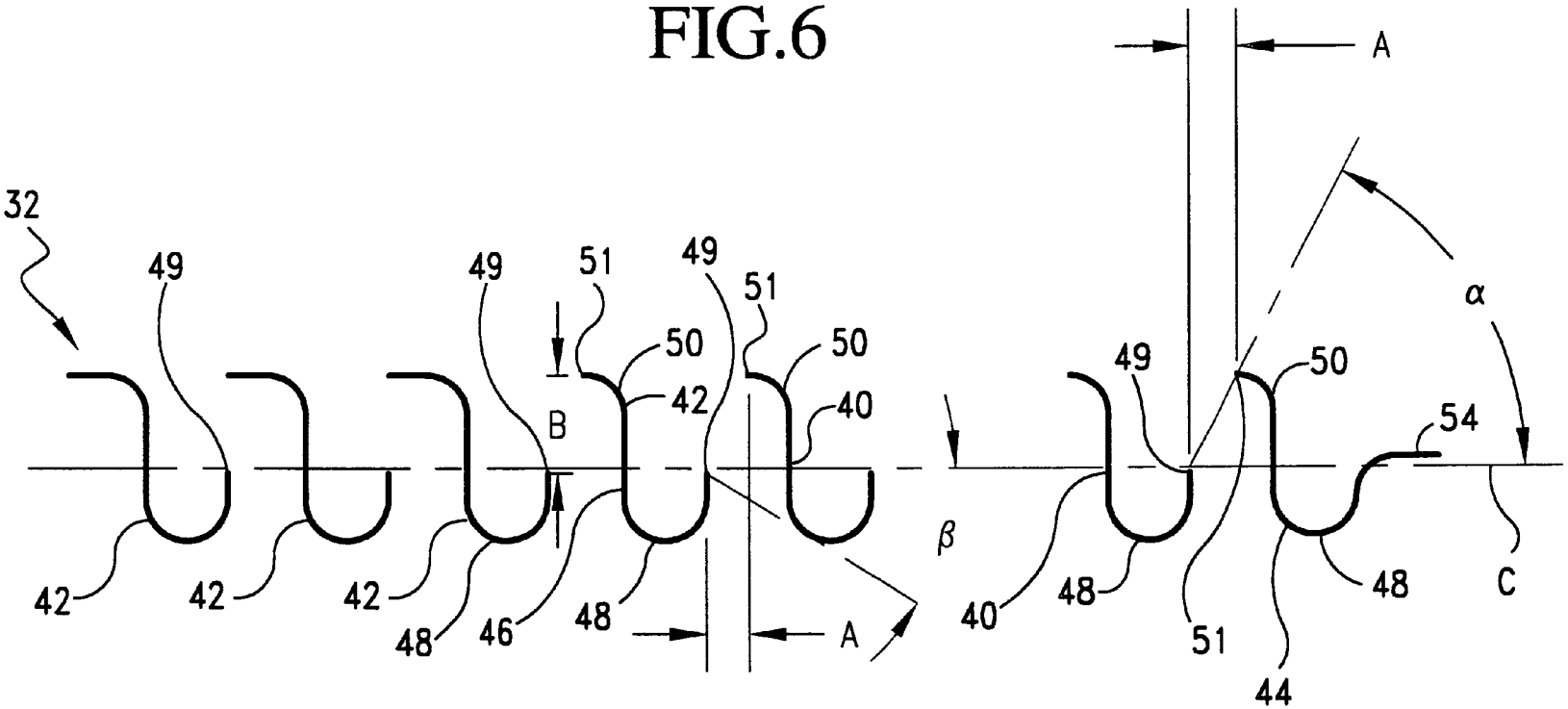
FIG. 6 is an enlarged view of three types of hook perforations placed along a tear line.

As can be seen from FIG. 6, showing several enlarged hooks 40, 42, and 44 placed along a tear line 32, the first hooks 40 are placed so that there is a horizontal gap A between the end or tip 49 of the rounded foot 48 of one hook 40 and the end or tip 51 of the rounded shoulder 50 of the following hook 40 or 44. The tip 49 of the rounded foot 48 of one hook, such as type #2 hook 42, and the tip 51 of the rounded shoulder 50 of the following or adjacent hook, such as first hook 40, are also vertically spaced creating a gap B. The horizontal and vertical gaps A and B provide high resistance to accidental tearing. An increase or decrease of these gaps will increase or decrease the tear resistance of the tear line 32, respectively, as when the permanent seal 16 is pulled vertically upward away from the bag, as commonly occurs when a bag is pulled out of a shipping case. Variations of top $\alpha$ and bottom $\beta$ tear capture angles will vary the probability of a tear propagating from the tip 49 of the rounded foot 49 of one hook to be captured by the following hook. The top rear capture angle $\alpha$ is the angle between a line parallel to the top 22 and bottom 24 edges of the bag 10, such as tear line center line C, and a line extending through the tip 49 of the rounded bottom 48 of one hook and the tip 51 of the rounded shoulder 50 of the following hook. The bottom tear capture angle $\beta$ is an angle between the center line C and a line extending through the tip 49 of the rounded foot 48 of one hook and extending to a point tangent to the rounded foot 48 of the following hook. If the propagating tear is not captured by the following hook, the tear will propagate longitudinally towards the top or the bottom of the bag.

The greater are the $\alpha$ and $\beta$ angles, the greater are the chances that the propagating tear is captured by the following hook perforation. The tear capture angles may be increased or decreased by placing hooks closer together or further apart from each other. The tear capture angles may also be changed by: 1) extending or shortening the end 51 of the rounded shoulder 50, i.e. increasing or decreasing gap A, or 2) raising or lowering the tip 49 of the rounded foot 48, thus increasing or decreasing gap B, or by increasing or decreasing the length of the vertical center section 46. However, increasing the tear capture angles will result in a decrease of accidental tear resistance, and, therefore, the tear capture angles $\alpha$ and $\beta$ should be chosen to maximize the overall performance of the tear line 32.

Figure 7A:
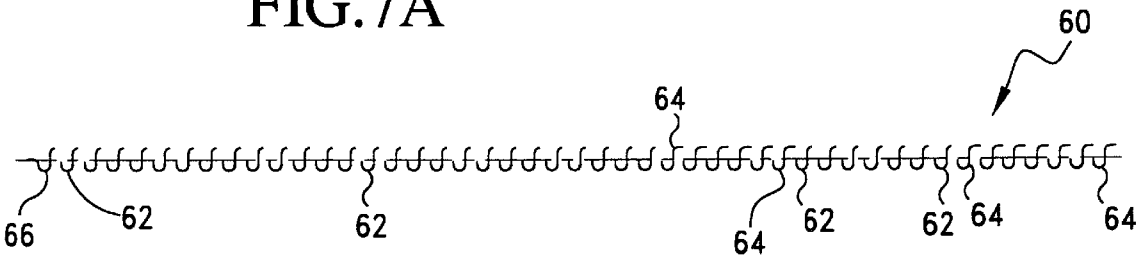
FIGS. 7A and 7B are views of a perforation knife, on different scales, as seen from the front of a bag in position to be cut by the perforation knife.
Figure 7B:
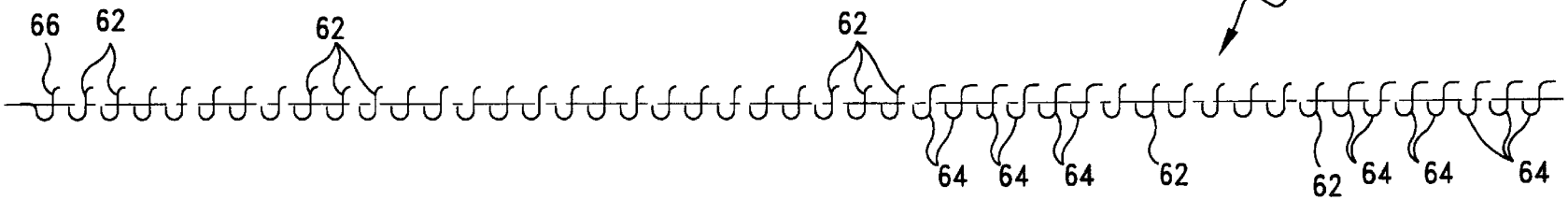

FIG. 7A shows a view of the cutting edge of the perforation blade on a scale of 1:1 and FIG. 7B shows an enlarged view of the cutting edge of the perforation blade according to one of the embodiments of the present invention which may be used to produce a fish hook tear line sandwich cookie bag. The blade 60 comprises a plurality of cutting surfaces 62–66 shaped in the form of fish hooks arranged in a straight line. The design of the blade corresponds and mirrors the design of the perforated line 32 of bag 10. The design of individual cutting hooks correspond to the design of the individual perforations of the line 32. Thus, cutting hooks 62, 64 and 66 reciprocates the design of perforation hooks 40, 42 and 44 respectively.

Figure 8:
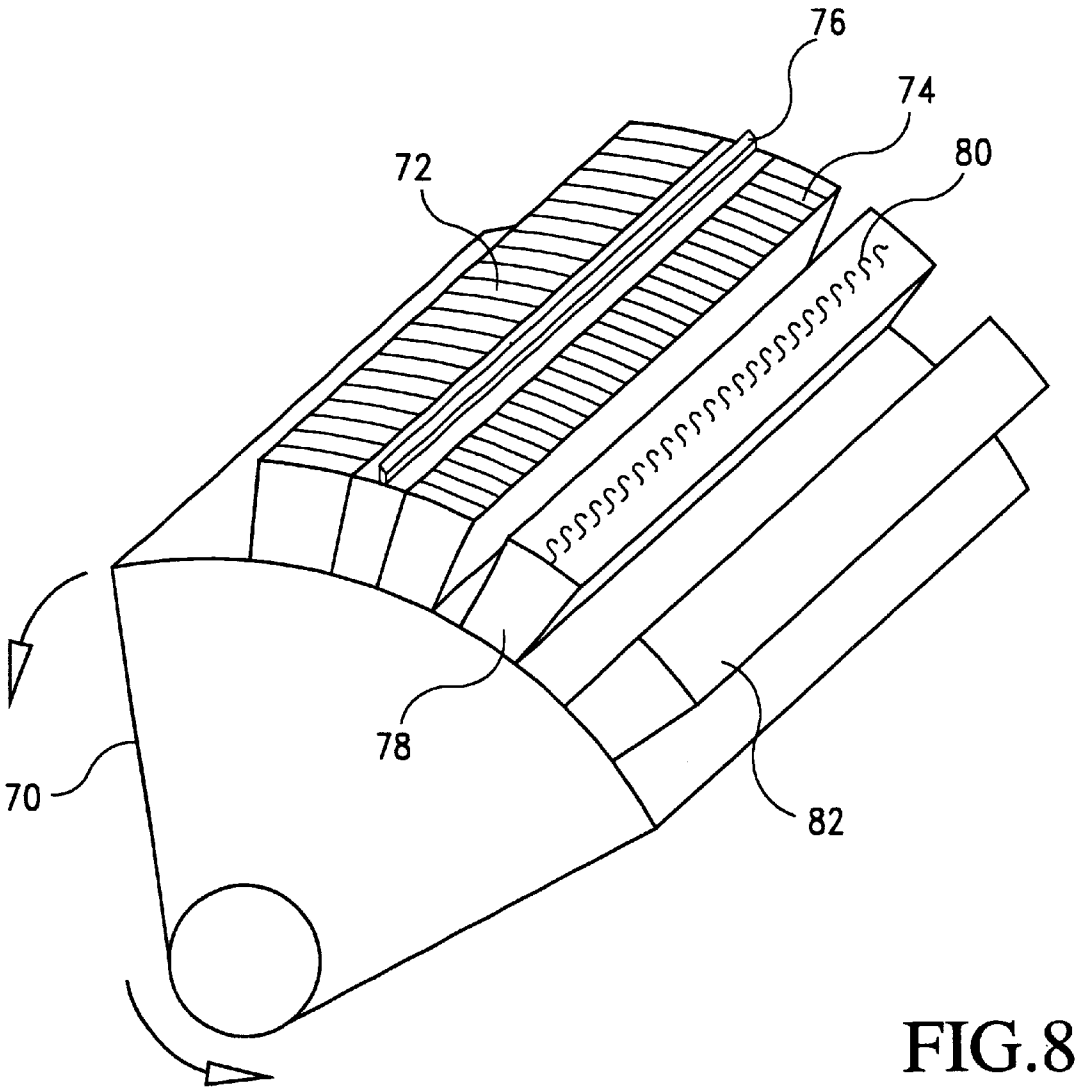
FIG. 8 is an enlarged perspective end view of a rotary crimping, sealing, cutting, and perforating head of the present invention.

FIG. 8 shows a schematic representation of one of the rotary crimping and sealing heads 70 comprising two crimping surfaces 72 and 74. Upon counter-clockwise rotation of the heads 70, the crimping surfaces 72 and 74 form a bottom seal 18 and a top seal 16, respectively, on successive bags 10, such as bag 10 shown in FIG. 1. A cutting blade 76, located between the crimping surfaces 72 and 74 cuts the film between the seals and separates the sealed film into individual successive bags. The crimping and sealing head 70 further comprises a perforation knife 78 with a fish hook cutting blade 80 for perforating a side wall of the bag 10 to obtain a perforation line 32. Located adjacent to the perforation knife 78 is a resilient pad 82 for closing a resealable seal 30 on bag 10.

What is claimed is:

1. A flexible bag comprising a first wall panel and a second wall panel each comprising a top edge, a bottom edge and two side edges, said first and said second wall panels being securely connected to one another by a first permanent seal located near the top edge of said panels; and a line of weakened tear resistance having a hook perforation design located below said permanent seal and extending across both said first and said second wall panels, wherein said line of weakened tear resistance comprises a plurality of cuts shaped in the form of a first hook each comprising a vertical center section substantially parallel to said side edges, a rounded shoulder connected to one end of said vertical center section, and a rounded bottom connected to another end of said vertical side.

2. A flexible bag as claimed in claim 1 wherein said rounded shoulder and said rounded bottom are located on opposite sides of said vertical center section.

3. A flexible bag as claimed in claim 2 wherein said line of weakened tear resistance extends substantially parallel to said permanent seal, and said first hooks are upright hooks.

4. A flexible bag as claimed in claim 2 wherein said bag is a resealable bag.

5. A flexible bag as claimed in claim 4 wherein a resealable seal is located below said line of weakened tear resistance and extends substantially parallel to said first permanent seal across said panels.

6. A flexible bag as claimed in claim 5 wherein said resealable seal is selected from reclosable interlocking profiles or a pressure sensitive adhesive seal.

7. A flexible bag as claimed in claim 1 wherein said line of weakened tear resistance comprises a notch at the beginning of said tear line.

8. A flexible bag as claimed in claim 3 wherein said line of weakened resistance further comprises a plurality of cuts shaped in the form of a second hook each having a vertical center section substantially parallel to said side edges, a rounded shoulder connected to one end of said substantially vertical center section, a rounded foot connected to another end of said vertical center section and a first arm connected to said rounded shoulder at the end of said rounded shoulder.

9. A flexible bag as claimed in claim 8 wherein said line of weakened resistance further comprises at least one cut shaped in the form of a third hook having a vertical side substantially parallel to said side edges, a rounded shoulder connected to one end of said substantially vertical side, a rounded bottom connected to another end of said vertical side and a side arm connected to the end of said rounded bottom through a rounded elbow.

10. A flexible bag as claimed in claim 9 wherein said first arm and said side arm are both substantially parallel to the top and the bottom edges of the first wall panel and the second wall panel.

11. A flexible bag as claimed in claim 1 wherein the heights of said hooks are from about 0.08 inch to about 0.2 inch.

12. A flexible bag as claimed in claim 3 wherein the top capture angle is greater than about 50°.

13. A flexible bag as claimed in claim 1 wherein the bottom capture angle is greater than about 15°.

14. A flexible bag as claimed in claim 1 wherein at least one or both of said first wall panel and second wall panel comprises at least one dimple depression to facilitate separation of the first wall panel and the second wall panel.

* * * * *